US007974430B2

(12) United States Patent
Izuchi et al.

(10) Patent No.: US 7,974,430 B2
(45) Date of Patent: Jul. 5, 2011

(54) MICROPHONE WITH DUST-PROOF SECTION

(75) Inventors: Toshiro Izuchi, Osaka (JP); Kazuo Ono, Osaka (JP); Kensuke Nakanishi, Osaka (JP); Hiroaki Onishi, Osaka (JP)

(73) Assignee: Hosiden Corporation, Osaka (JP)

( * ) Notice: Subject to any disclaimer, the term of this patent is extended or adjusted under 35 U.S.C. 154(b) by 1064 days.

(21) Appl. No.: 11/341,257

(22) Filed: Jan. 27, 2006

(65) Prior Publication Data

US 2006/0177085 A1 Aug. 10, 2006

(30) Foreign Application Priority Data

Feb. 9, 2005 (JP) ..... 2005-033175

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| *H04R 25/00* | (2006.01) |

(52) U.S. Cl. ..... 381/369; 381/174; 381/325

(58) Field of Classification Search ..... 381/170–181, 381/191, 325, 359, 369

See application file for complete search history.

(56) References Cited

U.S. PATENT DOCUMENTS

| | | | | |
|---|---|---|---|---|
| 4,071,040 A | | 1/1978 | Moriarty | |
| 4,640,382 A | | 2/1987 | Hartmann et al. | |
| 4,844,778 A | | 7/1989 | Witte | |
| 4,972,488 A | * | 11/1990 | Weiss et al. | 381/325 |
| 6,075,867 A | * | 6/2000 | Bay et al. | 381/191 |
| 6,512,834 B1 | | 1/2003 | Banter et al. | |
| 6,932,187 B2 | * | 8/2005 | Banter et al. | 181/149 |

(Continued)

FOREIGN PATENT DOCUMENTS

| | | |
|---|---|---|
| CN | 1344480 | 4/2002 |

(Continued)

OTHER PUBLICATIONS

Office action issued Sep. 25, 2009 for Chinese patent application No. 200610007125.2.

(Continued)

*Primary Examiner* — Davetta W Goins
*Assistant Examiner* — Matthew Eason
(74) *Attorney, Agent, or Firm* — David N. Lathrop

(57) ABSTRACT

In order to automate a microphone assembly process including a dust-proof treatment, an object of the present invention is to provide a dust-proof microphone having a configuration suitable for automated assembly.

According to the present invention, a microphone has a plate-like or film-like dust-proof section that is disposed in a conductive housing (capsule) having a sound aperture and covers the sound aperture. The dust-proof section has a plurality of pores at least in a region corresponding to the sound aperture, and the dust-proof section further has a nonporous region. In the case of an electret condenser microphone, from the viewpoint of performance of the microphone, the dust-proof section is conductive. In addition, taking into account a soldering in a reflow furnace, the dust-proof section is heat-resistant. Each pore is desirably designed taking into account the environment for the usage of the microphone. However, if it is supposed that the microphone is used near one's mouth, each pore has an area of 0.01 $mm^2$ or less. In addition, to enhance the dust-proof effect, the pores may be subjected to a water-repellent treatment.

22 Claims, 6 Drawing Sheets

U.S. PATENT DOCUMENTS

| | | | | |
|---|---|---|---|---|
| 7,269,268 | B2 * | 9/2007 | Song et al. | 381/174 |
| 2005/0089180 | A1 * | 4/2005 | Saeki et al. | 381/174 |

FOREIGN PATENT DOCUMENTS

| | | |
|---|---|---|
| EP | 1 473 966 | 11/2004 |
| EP | 1 494 503 | 1/2005 |
| JP | 59-125198 | 7/1984 |
| JP | 11-127498 | 5/1999 |
| JP | 2004-135223 | 4/2004 |
| JP | 2004-328231 | 11/2004 |

OTHER PUBLICATIONS

Extended European Search Report issued Aug. 13, 2010 for corresponding EP patent application No. 06 001703.5.

Second office action issued Nov. 8, 2010 for corresponding Chinese patent application No. 200610007125.2.

* cited by examiner

MICROPHONE WITH DUST-PROOF SECTION

BACKGROUND OF THE INVENTION

1. Field of the Invention

The present invention relates to an electronic device that has a dust-proof section over an opening of a housing thereof. In particular, it relates to a microphone having a dust-proof section.

2. Description of the Related Art

As disclosed in Japanese Patent Application Laid-Open No. 2004-328231, it is common practice to cover a sound aperture of a microphone with a cloth, such as a nonwoven fabric, to prevent entry of a foreign matter or dust from the sound aperture.

However, according to such a conventional dust-proof measure, a cloth has to be attached to a microphone with a double-sided tape or adhesive after fabrication of the microphone is completed. Thus, there exists an additional step of cloth attachment after assembly of the microphone. The cloth attachment step is difficult to automate, so that the entire fabrication process including the dust-proof treatment has not been able to be automated. In addition, the cloth cannot endure the heating during the soldering of the microphone in a reflow furnace. That is, the fabrication process including the cloth attachment step has not been able to be automated because of the poor heat resistance of the cloth or the like, too.

Another dust-proof measure is to cover a sound aperture of a microphone with a mesh member made of stainless steel. This measure also requires a step of covering the opening with the mesh member in addition to the microphone assembly step. Thus, this measure also has a problem with automation. In addition, a scrap of mesh member may be produced during processing of the mesh member, and the scrap may enter the microphone as a foreign matter or dust.

SUMMARY OF THE INVENTION

In order to automate a microphone assembly process including a dust-proof treatment, an object of the present invention is to provide a dust-proof microphone having a configuration suitable for automated assembly.

According to the present invention, a microphone has a plate-like or film-like dust-proof section that is disposed in a conductive housing (capsule) having a sound aperture and covers the sound aperture. The dust-proof section has a plurality of pores at least in a region corresponding to the sound aperture, and the dust-proof section further has a nonporous region. In the case of an electret condenser microphone, from the viewpoint of performance of the microphone, the dust-proof section is conductive. In addition, taking into account a soldering in a reflow furnace, the dust-proof section is heat-resistant. Each pore is desirably designed taking into account the environment for the usage of the microphone. However, if it is supposed that the microphone is used near one's mouth, each pore has an area of 0.01 $mm^2$ or less. In addition, the pores are subjected to a water-repellent treatment.

Configured as described above, the pores can prevent entry of a foreign matter, such as dust or water droplets, without reducing the sound pressure applied externally. Furthermore, since the nonporous region is provided, the dust-proof section can be held by a suction apparatus or the like. Therefore, the step of incorporating the dust-proof section into the microphone can be incorporated into the automated microphone assembly process.

DETAILED DESCRIPTION OF THE PREFERRED EMBODIMENT(S)

Figure 1:
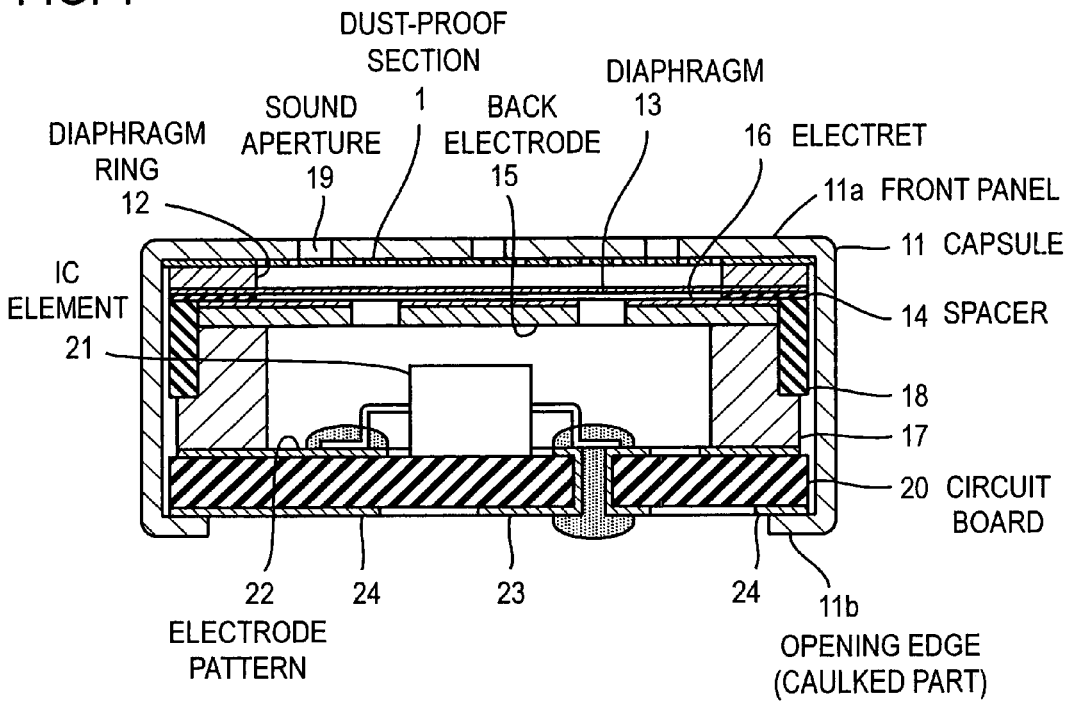
FIG. 1 is a cross-sectional view of a microphone according to an embodiment 1.

Embodiments of the present invention will be described with reference to the drawings. Like reference numerals denote like parts, and any redundancy of description will be omitted.

First Embodiment

FIG. 1 is a cross-sectional view of an example of an electret condenser microphone. Referring to FIG. 1, a cylindrical capsule 11 houses an electret condenser. To house built-in components such as the electret condenser, an opening of the capsule 11, which is opposite to a front panel 11*a* of the capsule 11, is sealed by a circuit board 20.

Viewed from the side of the front panel 11*a*, the capsule 11 houses a dust-proof section 1, a diaphragm ring 12, a diaphragm 13, a ring-shaped spacer 14, a back electrode 15, an electret 16, a cylindrical conductive body 17 mounted on the circuit board 20, and an insulating ring 18 fitted on the outer peripheries of the back electrode 15 and the cylindrical conductive body 17. The electret condenser comprises the diaphragm 13 stretched on the diaphragm ring 12, the ring-shaped spacer 14, and the electret 16, which covers the surface of the back electrode 15 facing to the front panel 11*a*. In general, the electret 16 is made of tetrafluoroethylene-hexafluoropropylene copolymer (FEP). On the surface of the circuit board 20 facing to the front panel 11*a* (that is, the mounting surface), an IC element 21 for impedance transformation, such as a field effect transistor (FET), is mounted and connected to an electrode pattern 22. On the outer surface of the circuit board 20 (that is, the implementing surface), there are formed terminal electrode patterns 23 and 24 for external connection.

The built-in components and the circuit board 20 are secured by caulking an opening edge 11*b* of the capsule 11 to bend the same inwardly. In other words, the circuit board 20 and the built-in components are pressed against and secured to the front panel 11*a* by the inwardly-bent caulked part 11*b*.

Figure 2A:
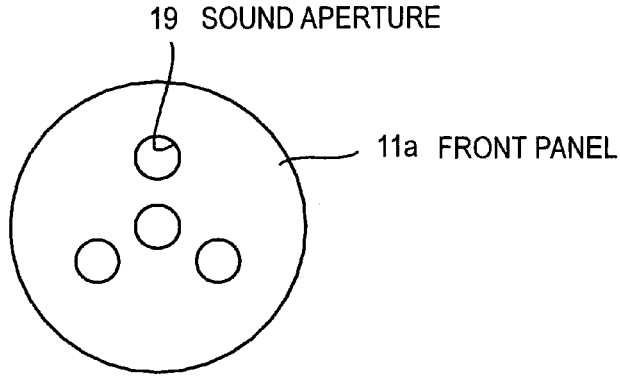
FIG. 2A is a plan view of an example of a front panel having a plurality of sound apertures.
Figure 2B:
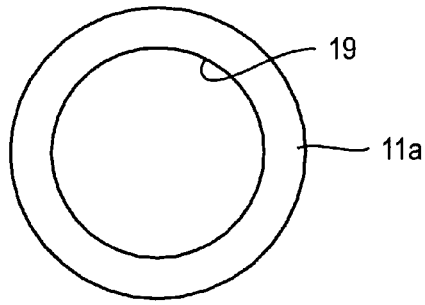
FIG. 2B is a plan view of an example of a front panel having one sound aperture.

The cylindrical conductive body 17 interconnects the back electrode 15 and the electrode pattern 22 on the circuit board 20. On the other hand, the diaphragm 13 is grounded by being connected to the terminal electrode pattern 24 via the diaphragm ring 12, the capsule 11 and the caulked part 11*b*. In this drawing, reference numeral 19 denotes a sound aperture formed in the front panel 11*a* of the capsule 11. The sound aperture 19 has to have a size enough to transmit the sound pressure from the outside of the microphone and permit sufficient vibration of the diaphragm 13. FIG. 2A shows an example in which a plurality of sound apertures 19 is formed. FIG. 2B shows an example in which one large sound aperture 19 is formed.

Figure 3:
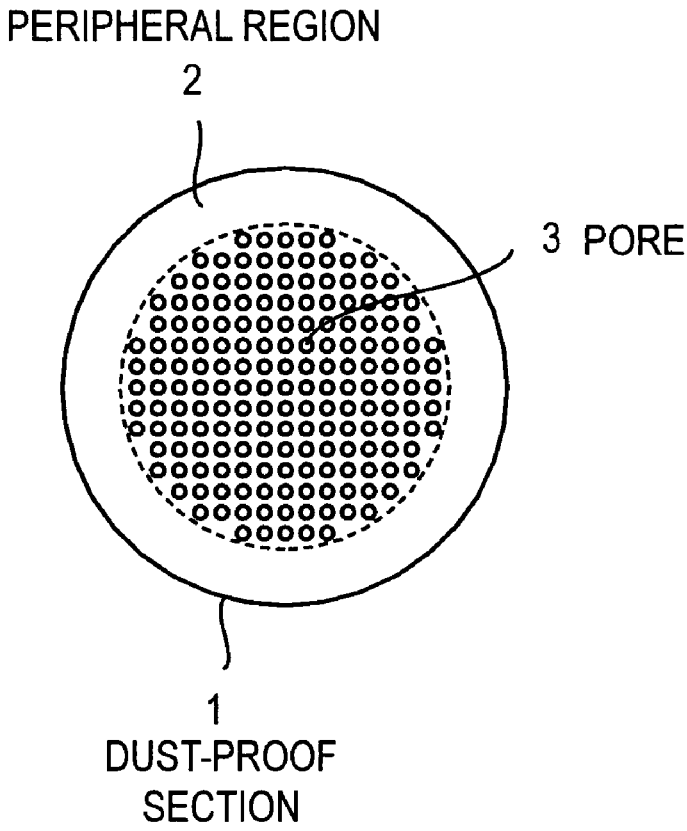
FIG. 3 is a plan view of an example of a dust-proof section having circular pores.

The dust-proof section 1 disposed inside the front panel 11*a* of the capsule 11 has a planar configuration shown in FIG. 3, for example. In plan view, the dust-proof section 1 has a circular shape conforming to the cylindrical capsule 11. The dust-proof section 1 has a nonporous peripheral region 2 that has a flat-plate-like structure. In addition, the dust-proof section 1 has a plurality of (or multiple) pores 3 at least in a region corresponding to the sound aperture 19 formed in the front panel 11*a* of the capsule 11. In FIG. 3, there are formed multiple pores 3 each of which is substantially circular.

In the case of the dust-proof section 1 shown in FIG. 3, the peripheral region 2 is interposed between the front panel 11*a* and the diaphragm ring 12 and pressed against the front panel 11*a*, thereby sealing any clearance between the front panel 11*a* and the diaphragm ring 12. Thus, dust or foreign matter can be prevented from being introduced into the capsule 11 from the periphery of the dust-proof section 1. In addition, the peripheral region 2 is advantageous for automatic assembly of the microphone, as described below. In an automatic assembly process, a suction apparatus is typically used to supply a small component. The nonporous region, such as the peripheral region 2, allows such a thin, small dust-proof section 1 to be picked up by the suction apparatus.

On the other hand, the pores 3 have to sufficiently transmit a sound pressure applied through the sound aperture 19 in the front panel 11*a* to allow the diaphragm 13 to vibrate according to the sound pressure. In addition, the pores 3 have to have a dust-proof function to prevent dust or foreign matter having passed through the sound aperture 19 from entering the capsule 11. To prevent entry of dust or foreign matter, the diameter of the pores 3 is preferably as small as possible. However, if the diameter is too small, the dust-proof section inhibits the transmission of the sound pressure. To achieve a tradeoff between these contradictory conditions, the pores have to be designed taking into account the environment for the usage of the microphone. Specifically, for each environment for the usage of the microphone, dust or foreign matter to be blocked out is identified, and each pore is designed to have a large diameter that does not inhibit the dust-proof function, or multiple pores of a small diameter are formed, for example. In a typical environment for the usage of the microphone, for example, multiple pores 3 having a diameter of about 0.1 mm are formed. In this case, the pores 3 can be readily formed by etching.

Furthermore, if the process of mounting the microphone on a substrate or the like includes a step of soldering the circuit board 20 to the substrate using a reflow furnace, the dust-proof section 1 has to be heat-resistant. That is, the dust-proof section 1 has a heat-resistance enough to resist the heat treatment for making the solder molten for bonding. For example, a thin metal plate, such as a copper foil or stainless steel thin plate plated with nickel for inhibiting oxidation, may be used. In addition, it is preferred that the dust-proof section 1 is conductive. This is because a conductive dust-proof section can cooperate with the front panel 11*a* of the capsule to prevent an induced noise from being introduced from the outside. Furthermore, the dust-proof section 1 can have a thickness from 50 μm to 75 μm, for example. The thickness falling within this range does not significantly increase the size of the microphone and does not inhibit mounting of the microphone on another apparatus.

Figure 4:
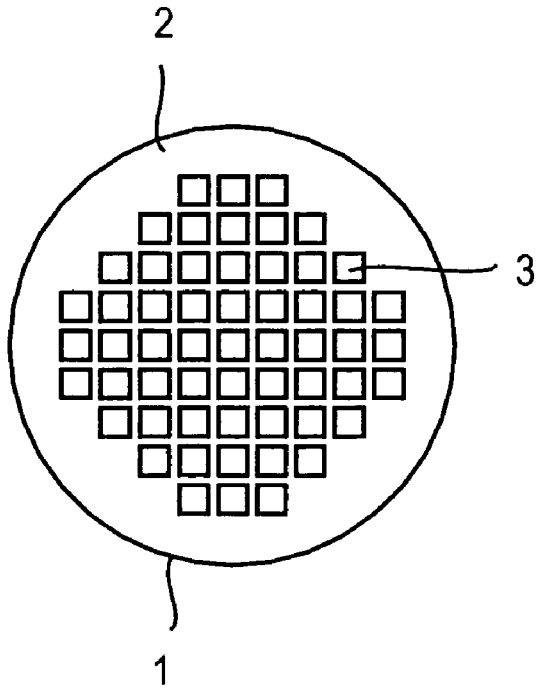
FIG. 4 is a plan view of an example of a dust-proof section having rectangular pores.

While FIG. 3 shows circular pores 3, FIG. 4 shows rectangular pores 3. In this case, the material and thickness of the dust-proof section 1, the size and number of the pores or the like can be determined as in the case of the circular pores. The pores 3 can have various shapes as far as the conditions of the pores described above are satisfied. In the case where the pores have a shape other than circular, the area of each pore should be 0.01 $mm^2$ or less.

In summary, the dust-proof section 1 is required to cover the entire sound aperture 19, to have a plurality of pores that can sufficiently transmit the sound pressure at least in a region corresponding to the sound aperture 19, and to have a nonporous region useful for the use of a suction apparatus.

Figure 5:
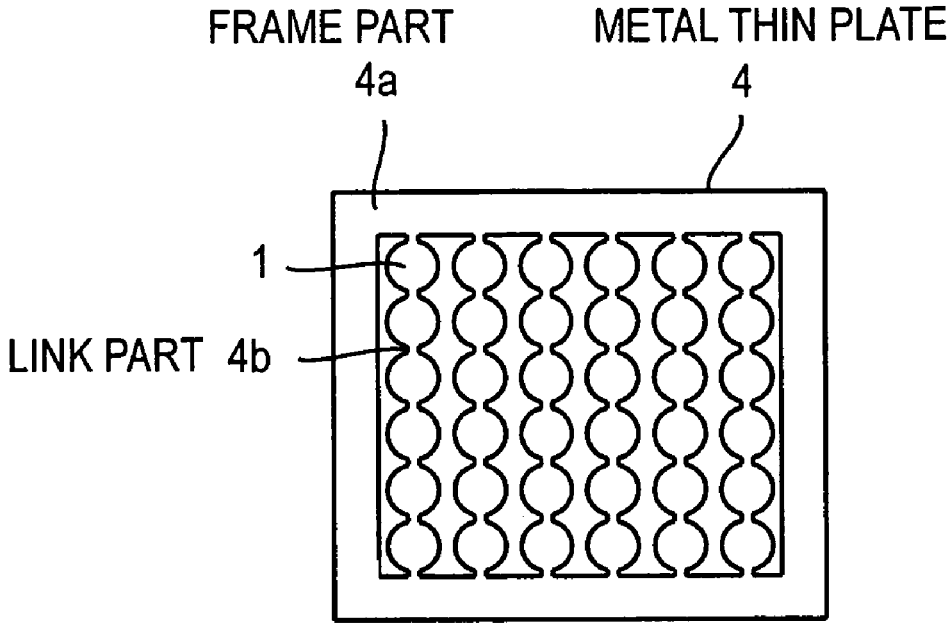
FIG. 5 is a plan view of a metal thin plate before dust-proof sections are separated off by punching.
Figure 6:
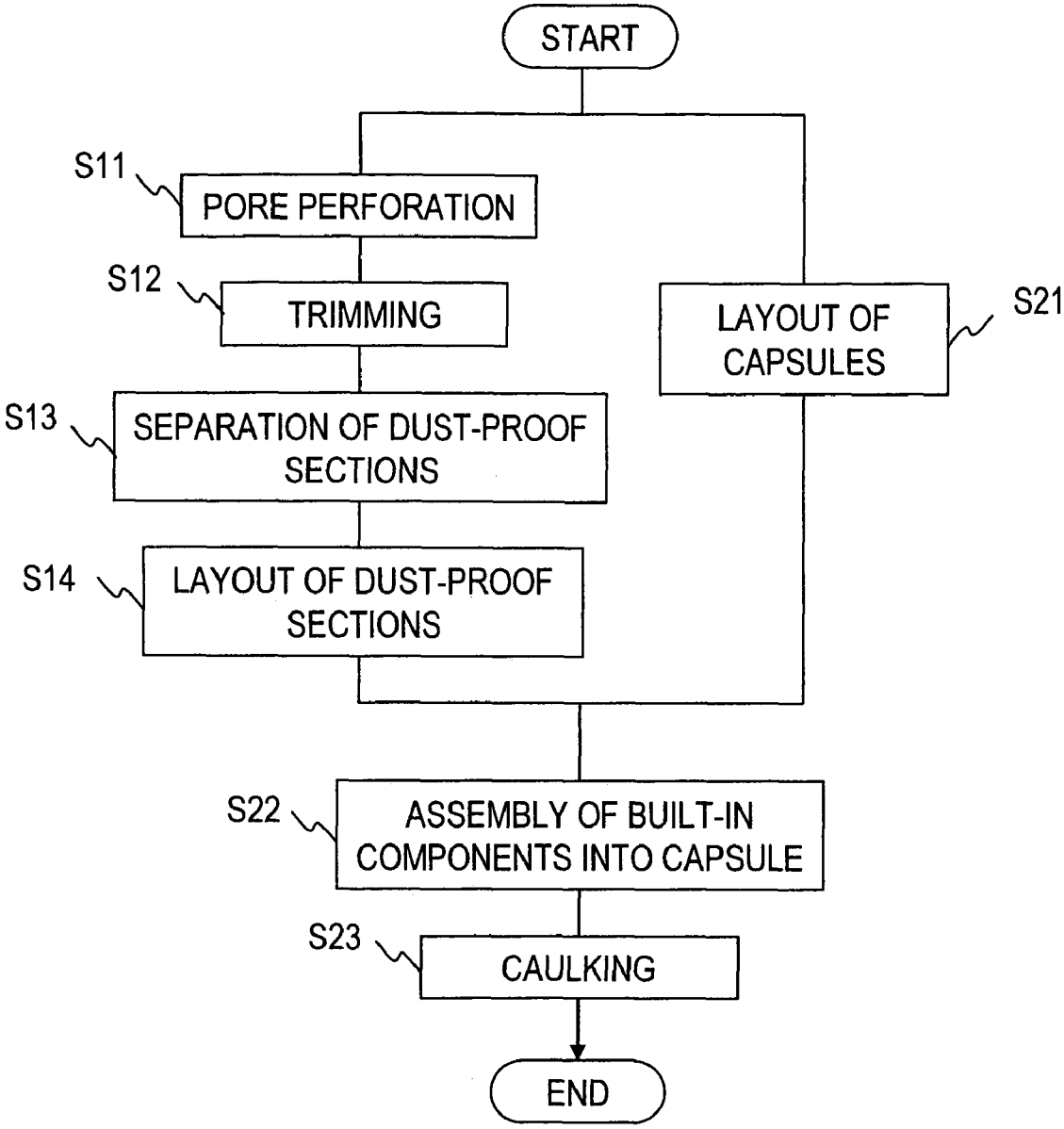
FIG. 6 is a flowchart showing a process of assembling the microphone according to the embodiment 1.

FIG. 5 shows a metal thin plate 4 used for fabricating the dust-proof section 1. FIG. 6 shows an automatic assembly process for assembling a dust-proof microphone using the metal thin plate 4 shown in FIG. 5. Each of circles shown in FIG. 5 represents one dust-proof section 1. Multiple pores 3 are formed in the rectangular metal thin plate 4, such as a copper foil or stainless steel plate, by etching or the like (S11). Then, the metal thin plate 4 is trimmed to remove the part other than the peripheral region 2 and the region of pores 3 (S12). In this regard, it is preferred that a plurality of dust-proof sections 1 are arranged in rows. That is, the metal thin plate 4 is trimmed leaving a frame part 4*a* and a link part 4*b* that interconnects dust-proof sections 1. After this step, a plurality of dust-proof sections 1 are formed in rows in one metal thin plate 4. Then, each dust-proof section 1 is separated off the metal thin plate 4 shown in FIG. 5 by punching, for example (S13). Then, the separated circular dust-proof sections 1 are laid side by side (S14). Each dust-proof section 1 is picked up by a suction apparatus attracting the peripheral region 2. Then, the dust-proof section 1 is dropped into each of capsules 11, which have a cylindrical shape and laid side by side with the openings facing upwards. A step of laying side by side the capsules 11 with the openings facing upwards (S21), a step of assembling other built-in components into the capsule 11 after the dust-proof section 1 is dropped into the capsule 11 (S22), a step of forming the caulked part 11*b* (S23) and the like are the same as conventional. This process allows automatic assembly of the dust-proof section 1 into the capsule 11.

The microphone is often used near one's mouth. Therefore, it is preferred that a water-repellent coating is formed on the surface of the dust-proof section 1 facing to the front panel (that is, the outer surface) or both the outer and the inner surface of the dust-proof section 1 at least in the region corresponding to the sound aperture 19. In this case, the coating is formed by plating, for example. If only the diameter of the pores 3 is equal to or less than 0.1 mm as described above, entry of water droplets (most of which is saliva) into the microphone can probably be prevented because of the surface tension of the droplets. However, entry of water droplets into the microphone can be prevented with higher reliability by the water-repellent treatment.

If at least the part of the dust-proof section 1 corresponding to the sound aperture 19 is colored black or the color of the housing of the microphone, the sound aperture 19 of the microphone can be made unobtrusive. To the contrary, if the part is colored a color that makes a striking contrast to the color of the housing of the microphone, the sound aperture 19 can be made conspicuous. The coloring can be performed by plating, printing, paint application, alumite treatment or the like.

Second Embodiment

Figure 7:
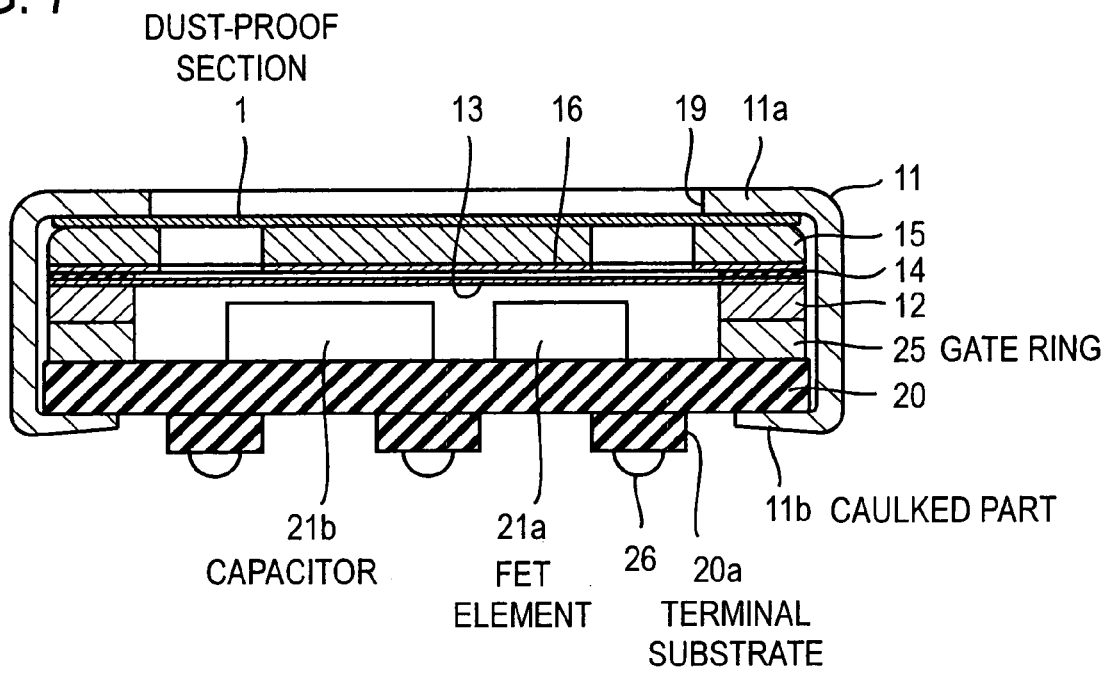
FIG. 7 is a cross-sectional view of a microphone according to an embodiment 2.

FIG. 7 shows an arrangement of a microphone according to this embodiment. In the embodiment 1, the dust-proof section 1 is disposed inside the front panel 11*a* of the capsule 11, and then the diaphragm 13 and the back electrode 15 are disposed in this order. However, in this embodiment, a dust-proof section 1 is disposed inside a front panel 11*a*, and then a back electrode 15 and a diaphragm 13 are disposed in this order. Then, a diaphragm ring 12 and a gate ring 25 are disposed. An electret 16 is disposed on the surface of the back electrode 15 facing to the diaphragm 13. The diaphragm 13 is electrically connected to a circuit board via the gate ring 25. An FET element 21*a* and a capacitor 21*b* are mounted on the inner surface of the circuit board 20. In addition, a terminal substrate 20*a* having a step protrudes from the outer surface of the circuit board 20. This is provided to prevent a caulked part 11*b* from being adversely affected by melting of solder 26 in a reflow furnace. In this embodiment, the shape or the like of the dust-proof section 1 is similar to that described with regard to the embodiment 1 with reference to FIGS. 3 to 5. However, in this embodiment, a large sound aperture 19 is formed in the front panel 11*a* as shown in FIG. 2(*b*). Thus, the dust-proof section 1 is required to have a higher shielding capability.

Third Embodiment

Figure 8:
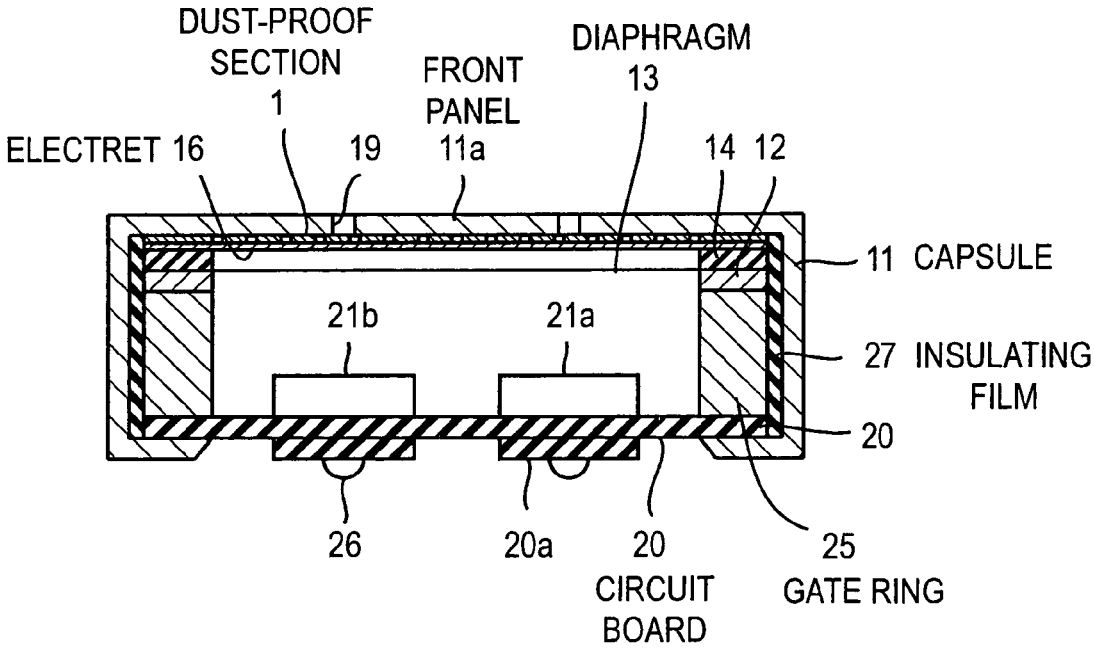
FIG. 8 is a cross-sectional view of a microphone according to an embodiment 3.

FIG. 8 shows an arrangement in which a front panel 11*a* of the capsule 11 serves also as a back electrode. In this microphone, a dust-proof section 1 is disposed inside the front panel 11*a*, and an electret 16 is disposed inside the dust-proof section 1. Then, a diaphragm 13 and a gate ring 25 are disposed in this order. Since an integral part doubles as the back electrode and the front panel 11*a*, and the electret 16 is disposed on the dust-proof section 1, the microphone can be extremely thin. In this embodiment, there is provided an insulating film 27 for insulating the capsule 11.

Fourth Embodiment

Figure 9:
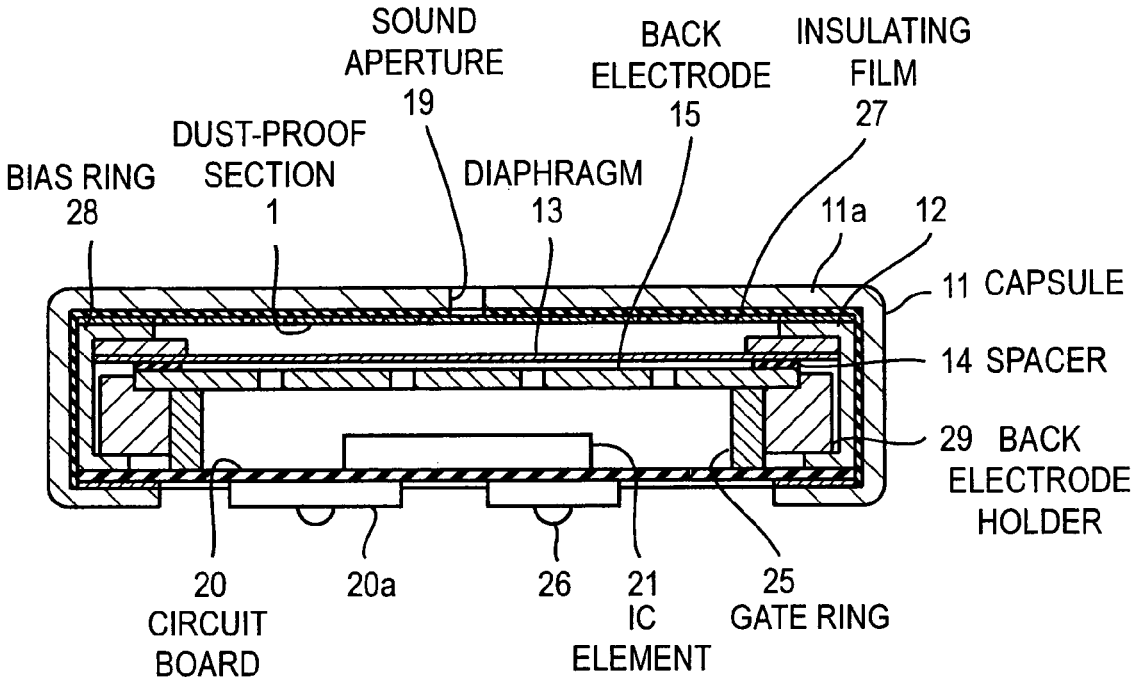
FIG. 9 is a cross-sectional view of a microphone according to an embodiment 4.

FIG. 9 shows an arrangement of a bias condenser microphone. With regard to the embodiments 1, 2 and 3, arrangements of an electret condenser microphone according to the present invention have been described. However, in this embodiment, a bias condenser microphone to which the present invention is applied will be described. In the case of the bias condenser microphone, a bias voltage has to be applied across a condenser. According to this embodiment, the inner surface of a capsule 11 is covered with an insulating film 27, and a bias ring 28 insulated from the capsule 11 is disposed inside the insulating film 27. In addition, a circuit board 20 applies a potential to a diaphragm 13 via the bias ring 28. In addition, a dust-proof section 1 is disposed between the bias ring 28 and the part of the insulating film 27 covering a front panel 11*a* of the capsule 11. In addition, inside the bias ring 28, the diaphragm 13 and a back electrode 15 are disposed in this order. The back electrode 15 is supported by a back electrode holder 29 and electrically connected to the circuit board 20 via the gate ring 25. In this embodiment, the dust-proof section 1 can be thinner to the extent that it can be referred to as film-like, rather than flat-plate-like, and can be previously bonded to the insulating film 27 for implementation.

The above description has been focused on the microphone. However, the present invention can be equally applied to other precision electronic components having a sound aperture or a hole, such as a speaker and a buzzer.

In addition, for providing an extremely small microphone, in the case of conventional cloth, the thickness thereof (0.1 mm or 0.2 mm, for example) may cause a problem. However, according to the present invention, since a thin plate or film is used for the dust-proof section, there arises no problem about the thickness of the microphone.

What is claimed is:

1. A microphone comprising:

a conductive housing that has a front panel closing one end of the housing and having a sound aperture, a dust-proof section that is disposed in said housing and covers said front panel so as to cover said sound aperture, and an electret condenser having a back electrode and a diaphragm at an inner position than said dust-proof section, wherein said housing secures the dust-proof section and components comprising the back electrode and the diaphragm in the microphone by caulking of an opening edge of the housing, said dust-proof section has a porous region with a plurality of pores at least in a region corresponding to said sound aperture, said dust-proof section further has a nonporous region, and the porous region and the nonporous region are formed in a plate.

2. The microphone according to claim 1, wherein said plate is conductive.

3. The microphone according to claim 1, wherein said dust-proof section is heat-resistant.

4. The microphone according to claim 1, wherein all the pores in the region corresponding to said sound aperture are subjected to a water-repellent treatment.

5. The microphone according to claim 1, wherein said nonporous region enables said dust-proof section to be picked up by a suction apparatus.

6. The microphone according to claim 1, wherein each pore in the region corresponding to said sound aperture has a diameter of about 0.1 mm.

7. A microphone comprising:

a conductive housing that has a front panel closing one end of the housing and having a sound aperture, a dust-proof section that is disposed in said housing and covers said front panel so as to cover said sound aperture, and an electret disposed at an inner position than said dust-proof section and a diaphragm disposed at an inner position than the electret, wherein said housing secures the dust-proof section and components comprising the electret and the diaphragm in the microphone by caulking of an opening edge of the housing, and said housing serves also as a back electrode, and wherein said dust-proof section has a porous region with a plurality of pores at least in a region corresponding to said sound aperture, said dust-proof section further has a nonporous region, and the porous region and the nonporous region are formed in a plate.

8. The microphone according to claim 7, wherein said plate is conductive.

9. The microphone according to claim 7, wherein said dust-proof section is heat-resistant.

10. The microphone according to claim 7, wherein all the pores in the region corresponding to said sound aperture are subjected to a water-repellent treatment.

11. The microphone according to claim 7, wherein said nonporous region enables said dust-proof section to be picked up by a suction apparatus.

12. The microphone according to claim 7, wherein each pore in the region corresponding to said sound aperture has a diameter of about 0.1 mm.

13. A microphone comprising:

a conductive housing that has a front panel closing one end of the housing and having a sound aperture, an insulating film disposed on an inner surface of said housing, a dust-proof section that is disposed in said housing and covers said front panel so as to cover said sound aperture, the dust-proof section is disposed at an inner position than said insulating film, a bias ring disposed at an inner position than the dust-proof section, and a diaphragm and a back electrode disposed at inner positions than the bias ring, wherein said housing secures the dust-proof section and components comprising the bias ring, the diaphragm and the back electrode in the microphone by caulking of an opening edge of the housing, and said dust-proof section has a porous region with a plurality of pores at least in a region corresponding to said sound aperture, said dust-proof section further has a nonporous region, and the porous region and the nonporous region are formed in a plate.

14. The microphone according to claim 13, wherein said plate is conductive.

15. The microphone according to claim 13, wherein said dust-proof section is heat-resistant.

16. The microphone according to claim 13, wherein all the pores in the region corresponding to said sound aperture are subjected to a water-repellent treatment.

17. The microphone according to claim 13, wherein said nonporous region enables said dust-proof section to be picked up by a suction apparatus.

18. The microphone according to claim 13, wherein each pore in the region corresponding to said sound aperture has a diameter of about 0.1 mm.

19. A method for manufacturing a microphone, wherein the microphone comprises:

a conductive housing that has a front panel closing one end of the housing and having a sound aperture, a dust-proof section that is disposed in said housing and covers said front panel so as to cover said sound aperture, wherein said dust-proof section has a porous region with a plurality of pores at least in a region corresponding to said sound aperture, said dust-proof section further has a nonporous region, and the porous region and the nonporous region are formed in a plate, and a diaphragm; and wherein the method comprises:

picking up the dust-proof section by a suction apparatus attracting the nonporous region;

using the suction apparatus to set the dust-proof section into the housing;

assembling built-in components comprising the diaphragm into the housing; and securing the dust-proof section and the built-in components in the microphone by caulking an opening edge of the housing.

20. The method according to claim 19, wherein:

the microphone comprises an electret condenser having a back electrode and the diaphragm, the built-in components further comprise the back electrode; and the method comprises assembling the built-in components such that the diaphragm is disposed in said housing at an inner position than said dust-proof section.

21. The method according to claim 19, wherein:

the microphone further comprises an electret, the built-in components further comprise the electret; and the method comprises assembling the built-in components such that:

the electret is disposed in the housing at an inner position than said dust-proof section, the diaphragm is disposed in said housing at an inner position than the electret, and the housing serves as a back electrode.

22. The method according to claim 19, wherein:

the microphone further comprises an insulating film, a bias ring and a back electrode, the built-in components further comprise the an insulating film, the bias ring and the back electrode; and the method comprises assembling the built-in components such that:

the insulating film is disposed on an inner surface of the housing, the bias ring is disposed in the housing at an inner position than said dust-proof section, and the diaphragm and the back electrode are disposed in said housing at an inner position than the bias ring.

* * * * *